US006377877B1

(12) United States Patent
Doner

(10) Patent No.: US 6,377,877 B1
(45) Date of Patent: Apr. 23, 2002

(54) METHOD OF DETERMINING RAILYARD STATUS USING LOCOMOTIVE LOCATION

(75) Inventor: John R. Doner, Melbourne, FL (US)

(73) Assignee: GE Harris Railway Electronics, LLC, Melbourne, FL (US)

( * ) Notice: Subject to any disclaimer, the term of this patent is extended or adjusted under 35 U.S.C. 154(b) by 0 days.

(21) Appl. No.: 09/662,777

(22) Filed: Sep. 15, 2000

(51) Int. Cl.[7] ..... G05D 3/00

(52) U.S. Cl. ..... 701/19; 701/20; 246/2 R; 246/122 R

(58) Field of Search ..... 701/19, 20, 207, 701/213, 205; 340/500, 933, 988; 246/2 R, 122 R

(56) References Cited

U.S. PATENT DOCUMENTS 4,711,418 A * 12/1987 Aver, Jr. et al. ..... 246/5
5,177,684 A * 1/1993 Harker et al. ..... 364/436
5,986,547 A * 11/1999 Korver et al. ..... 340/500

* cited by examiner

*Primary Examiner*—Yonel Beaulieu
(74) *Attorney, Agent, or Firm*—Carl Rowold; Armstrong Teasdale LLP

(57) ABSTRACT

A system for determining the status of a railyard includes a locomotive itinerary, a computer configured with a comparator algorithm used to compare a locomotive location to the locomotive itinerary, and at least one manager console configured to communicate with the computer. Railcar information is input to the manager console and communicated to the computer, which generates a locomotive task list from the railcar information. The computer then generates a locomotive itinerary, tracks the location of the locomotive and uses the comparator algorithm to determine the schedule status of the railcar.

24 Claims, 4 Drawing Sheets

METHOD OF DETERMINING RAILYARD STATUS USING LOCOMOTIVE LOCATION

BACKGROUND OF THE INVENTION

This invention relates generally to railyards, and more particularly to means by which the status of a railyard can be partially or wholly determined using known locations of locomotives within the railyard.

Railyards are the hubs of railroad transportation systems. Therefore, railyards perform many services, for example, freight origination, interchange, and termination, locomotive storage and maintenance, assembly and inspection of new trains, servicing of trains running through the facility, inspection and maintenance of railcars, and railcar storage. The various services in a railyard compete for resources such as personnel, equipment, and space in various facilities so that managing the entire railyard efficiently is a complex operation.

The railroads in general recognize that yard management tasks would benefit from the use of management tools based on optimization principles. Such tools use the current yard status and the list of tasks to be accomplished to determine an optimum order in which to accomplish these tasks.

However, any management system relies on credible and timely data concerning the present state of the system under management. In most railyards, the current data entry technology is a mixture of manual and automated methods. For example, automated equipment identification (AEI) readers and hump computers determine the location of railcars at some points in the sequence of operations, but in general, this limits knowledge of a railcar's whereabouts to at most the moment at which it arrived, the moment at which it crossed the hump, and the moment at which it departs. There exists a need for a more effective railyard management system to determine the locations of railcars at intermediate steps to have information sufficient to assess railyard status.

BRIEF SUMMARY OF THE INVENTION

In one embodiment, a system for determining the status of a railyard (i.e. location of assets and state of completion of tasks) utilizing the knowledge of locomotive location is provided. The system includes a locomotive itinerary, a comparator algorithm for comparing a locomotive location to the locomotive itinerary, a computer configured with the comparator algorithm, and at least one manager console that communicates with the computer.

To effectively manage a railyard and determine the locations of railcars during many different phases of the railyard management process, the location of locomotives in the railyard is used. Since railcars rarely move without the use of locomotive power, assessment of the location of railcars is determined by continually tracking locomotive motions in the railyard, and comparing those activities with the railcar movement tasks assigned to specific locomotives.

In operation, information relating to scheduled procedures to be performed to a railcar are input to the manager console and communicated to the computer. Procedures such as loading or unloading product to or from a railcar and maintenance to the railcar are input into the manager consoles and the computer compiles information and creates a schedule of the procedures. The computer generates a locomotive itinerary to move the railcar to specified track locations at specified times to perform the designated railcar procedures. Additionally, the computer tracks the location of the locomotive and executes a comparator algorithm to compare the real-time location of the locomotive to the locomotive itinerary. The computer then uses this comparison to determine the schedule status of the railcar.

DETAILED DESCRIPTION OF THE INVENTION

As used herein, the term "locomotive consist" means one or more locomotives physically connected together, with one locomotive designated as a lead locomotive and other locomotives designated as trailing locomotives. A "train" consist means a combination of cars (freight, passenger, bulk) and at least one locomotive consist.

Figure 1:
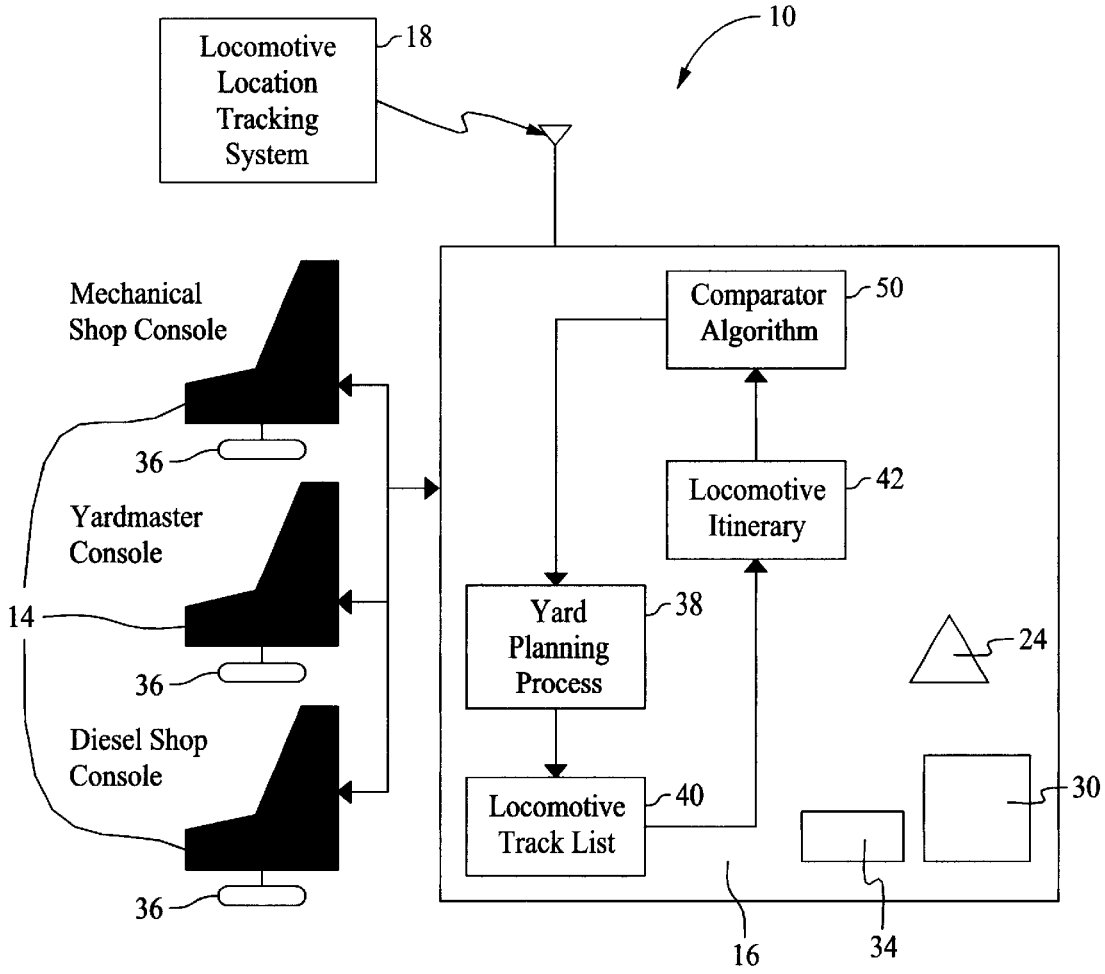
FIG. 1 is a diagram of a management system for implementing a railyard management process using locomotive location in accordance with an exemplary embodiment of the present invention.

FIG. 1 is a diagram of a management system 10 for implementing a railyard management process using locomotive location in accordance with an exemplary embodiment of the present invention. System 10 includes at least one manager console 14, which communicates with a base station computer 16. System 10 further includes a locomotive tracking system 18 that communicates locomotive location data to computer 16. Computer 16 includes a processor 24 sufficient to execute all computer functions, a display 30 for viewing information, and an input device 34. Locomotive tracking system 18 is coupled to a locomotive and can determine the location of a locomotive on a specific track within a network of tracks in a railyard. In one embodiment, locomotive location tracking system 18 is a Global Positioning Satellite system (GPS).

Manager consoles 14 allow various resource managers to specify railyard activities. For example, the mechanical manager is responsible for repairs of railcars and moving railcars into and out of storage, the diesel manager is responsible for supplying, servicing and storing locomotive power, and the yardmaster is responsible for train building activity in the railyard. Additionally, depending on the size and scope of the railyard, there may also be other planning authorities within the yard. Each resource manager specifies tasks and enters the tasks into manager consoles 14, using an input device 36. Manager consoles 14 are linked to a computer 16 by a network, for example, a local area network (LAN).

As tasks entered by the resource managers are entered into manager consoles 14 the tasks are communicated to computer 16. Computer 16 includes a yard planning process 38, a locomotive task list 40 created using yard planning process 38, a locomotive itinerary 42, which is compiled by assigning tasks in task list 40 with approximate start and ending times, and a comparator algorithm 50 used to compare locomotive locations with itinerary 42 to determine railyard status. In an alternate embodiment, comparator algorithm 50 is included in a suitable means capable of executing comparator algorithm 50.

Since locomotives travel only on tracks, and specific tracks in railyards have specific purposes, many of the tasks assigned to a locomotive involve predictable locomotive movements on the specific tracks. Therefore, knowing a locomotive location at any time provides information on the status of all tasks involving the locomotive. For example, knowing that a locomotive is presently at a specific point on a specific track indicates the function or operation the locomotive is in the process of performing, the functions or operations the locomotive has completed, and the approximate timeliness of future functions or operations. Since a railcar location can be determined by knowing the present and past location of the locomotive used to position the railcar, comparator algorithm 50 is used to compare locomotive location data with locomotive itinerary 42, to determine a railcar location, and thus railyard status. Railyard status information from comparator algorithm 50 is then used as input information in yard planning process 38.

Figure 2:
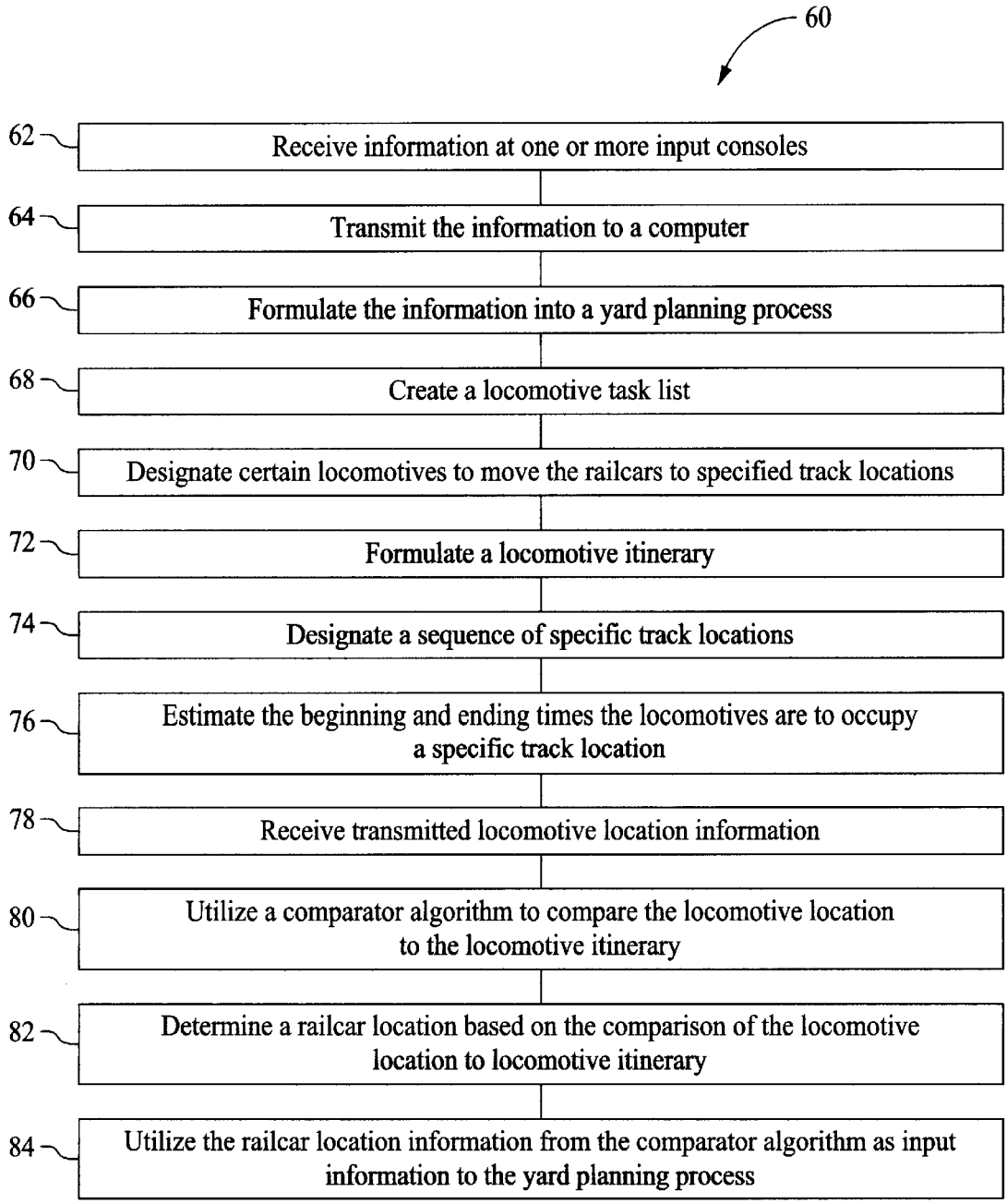
FIG. 2 is a diagram of a railyard management process used with the management system shown in FIG. 1.

FIG. 2 is a flow chart of a railyard management process 60 utilized with a management system, such as management system 10 (shown in FIG. 1). Information is received 62 at one or more input consoles, such as manager consoles 14 (shown in FIG. 1), regarding tasks pertaining to railcars and locomotives located in the railyard. The information is input into manager consoles 14 by various yard managers. The information is transmitted 64 to computer 16 (shown in FIG. 1), which formulates 66 the information into a yard planning process, such as yard planning process 38 (shown in FIG. 1). System 10 creates 68 a locomotive task list, such as locomotive task list 40 (shown in FIG. 1), by assigning locomotives to the various tasks to be performed. Locomotive task list 40 designates 70 certain locomotives to move the railcars to specified track locations.

A locomotive itinerary, such as locomotive itinerary 42 (shown in FIG. 1), is formulated 72 that is based on locomotive task list 40 and the times railcar activities are scheduled. In one embodiment, the locomotive itinerary designates 74 a sequence of specific track locations within a network of tracks that various locomotives are to occupy. The locomotive itinerary also estimates 76 the beginning and ending times the locomotives are to occupy a specific track location. As a locomotive performs the tasks designated by the locomotive itinerary, information is transmitted by a tracking system, such as locomotive location tracking system 18, (shown in FIG. 1).

Computer 16 receives 78 the transmitted locomotive location information and utilizes 80 an algorithm, such as comparator algorithm 50 (shown in FIG. 1), to compare the locomotive location to locomotive itinerary 42. Since many of the tasks pertaining to the railcars specified in yard planning process 38 utilize locomotives, computer 16 determines 82 a railcar location, and thus railyard status based on the comparison of the locomotive location to locomotive itinerary 42. Computer 16 utilizes 84 the railyard status information from comparator algorithm 50 as input information to yard planning process 38. In an alternate embodiment locomotive itinerary 42 is formulated by a processing unit other than computer 16.

In an alternate embodiment locomotive itinerary 42 is formulated by suitable means, other than computer 16, which is part of the network including computer 16 and manager consoles 14.

Figure 3:
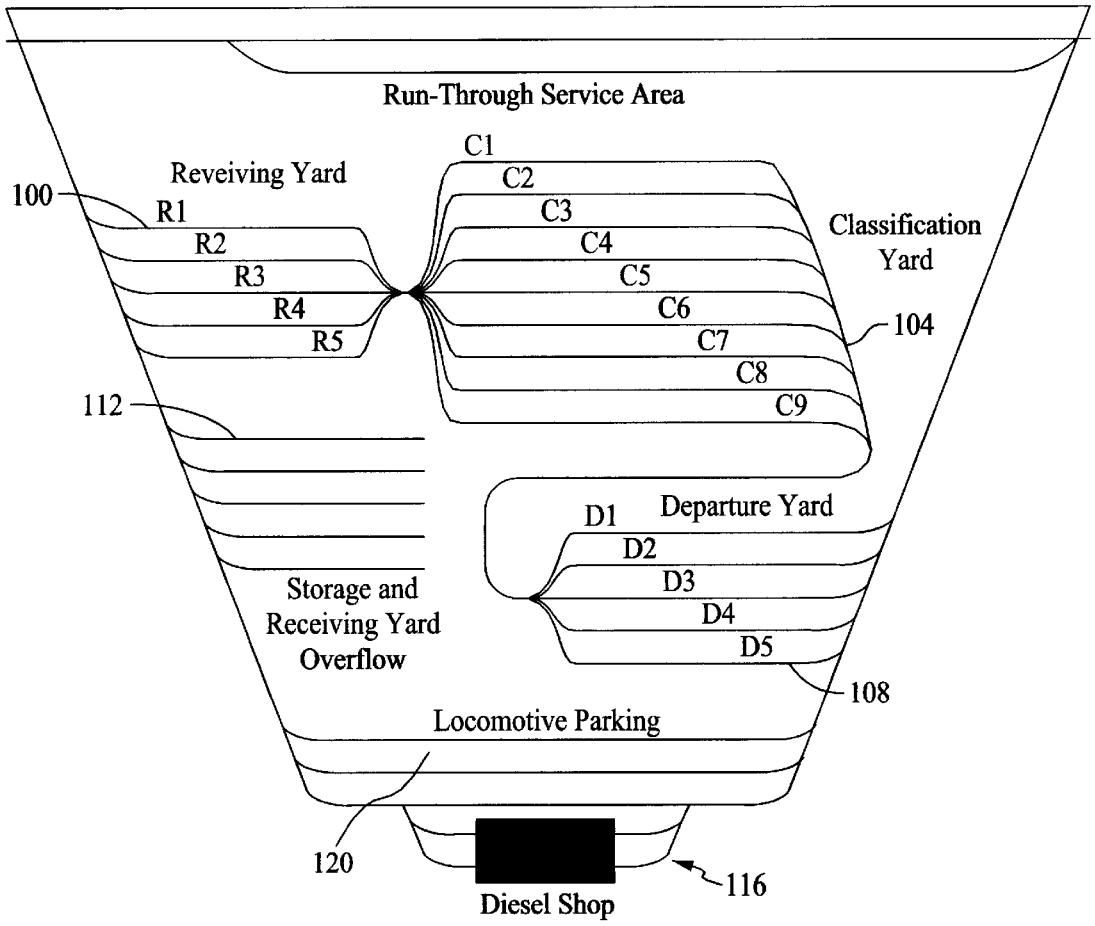
FIG. 3 is a diagram of a railyard layout for illustrating the railyard management process shown in FIG. 2.

FIG. 3 is a diagram of a railyard layout for illustrating particular purposes and activities involved in the railyard management process. A railyard comprises various sets of tracks dedicated to specific uses or functions. For example, if an incoming train arrives in a receiving yard 100 and has been assigned a specific receiving track, then at some later time, a switch engine will enter that track and move the railcars from that train to tracks in a classification area 104. The tracks in the classification area are likewise assigned to hold specific blocks of railcars being assembled for outbound trains, but when the block of railcars is completed, the block will be destined for a specific track in a departure yard 108 assigned for the relevant outgoing train. When all of the blocks of railcars for a departing train are assembled, one or more locomotives from a locomotive storage yard 112, usually near a diesel shop 116, will be moved and attached to the train.

Figure 4:
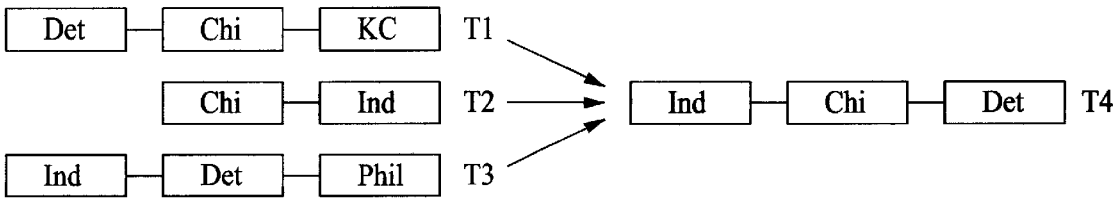
FIG. 4 is a schematic diagram representing a train building process included in the railyard management process shown in FIG. 2.

FIG. 4 is a schematic diagram representing the train building process included in the yard management process. Suppose, for example, that three eastbound trains T1, T2, T3 are terminating in a yard in Kansas City with railcars in their train consists bound for the following cities:

T1—railcars for Kansas City, Chicago, Detroit;

T2—railcars for Chicago, Indianapolis;

T3—railcars for Indianapolis, Detroit, and Philadelphia.

As used herein, the term "locomotive consist" means one or more locomotives physically connected together, with one locomotive designated as a lead locomotive and the others as trailing locomotives. A "train" consist means a combination of railcars (freight, passenger, bulk) and at least one locomotive consist. Train T4, departing later that day, has an itinerary covering Indianapolis, Chicago, and Detroit, in that order. The railcars from T1, T2, and T3 bound for these cities are to be blocked together by city, and then assembled into the consist of train T4. Note that T4 is arranged so that it may drop its various blocks from the back of the train.

The process of assembling T4 requires the use of receiving yard 100, classification yard 104, and departure yard 108 tracks, shown in FIG. 3. As part of the overall daily tasking for the yard, assignments must be made as to which tracks will be used to assemble T4, and which locomotive(s) will execute the required train building operations.

Figure 5:
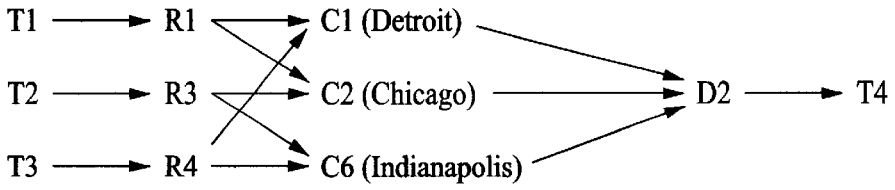
FIG. 5 is a schematic diagram representing the train building process shown in FIG. 4.

FIG. 5 is a detailed schematic representation of the train building process shown in FIG. 3. FIG. 4 shows the three trains T1, T2, T3 arriving and occupying receiving tracks R1, R3, and R4, respectively. At least some (not necessarily all) of the railcars on these trains will constitute train T4, the departing train. Some of the railcars of each of T1, T2, and T3 are placed on classification tracks C1, C2, and C6. This activity of creating railcar blocks for train T4 on separate classification tracks allows T4 to finally be assembled with railcars blocked separately for separate cities, and in the order of dropoff (i.e. dropoffs at the first city enroute are placed separate at the back of the train), as shown in FIG. 3. The railcar blocks, when complete, will be pulled forward to departure yard 108, shown in FIG. 3, and assembled into the consist of train T4 on track D2.

Each of the arrows in FIG. 4 represent a task within the process of building train T4, and each arrow also represents a specific move from one track to another. Each move of railcars will involve locomotives. For example, when the inbound trains arrive in receiving yard 100 (shown in FIG. 3), when the railcars are switched into classification yard 104 (shown in FIG. 3), when the railcars are switched into departure yard 108 (shown in FIG. 3), and when T4 departs, locomotives are required to implement the railcar movement. Also, each move is orchestrated to occur on specific tracks, proceeding according to a general list of tasks in the yard representing the sequential building of all trains. It is therefore possible to determine what train building task is underway at any moment by correlating the locations of locomotives in the yard with the tasks which should be active, according to the current schedule. This information can be used to assess whether a task is ahead or behind schedule, which then provides credible real-time input to yard planning process 38 (shown in FIG. 2).

The use of locomotive location data is also of value to the Diesel Manager. For example, a locomotive which is detached from an incoming train will normally be temporarily stored in a locomotive parking area 120 (shown in FIG. 3) or may be slated for service in diesel shop 116 (shown in FIG. 3). Assessing the location of such a locomotive provides information pertaining to its status, which can help determine if the locomotive is parked, awaiting assignment, parked awaiting service, currently in the shop, or parked on the lead-out tracks from the shop, and ready for assignment. The arrangement of locomotives in the parking area can have considerable impact on the feasibility of assigning them to specific outbound trains, and yard planning process 38 can benefit substantially from real-time, accurate assessment of the locations of parked locomotives.

System 10 (shown in FIG. 1) uses a tracking system and computer to track the location of a locomotive then uses a locomotive itinerary and location information as input data for a comparator algorithm. The comparator algorithm is then used to compare the present location of the locomotive to the location the locomotive itinerary stipulates, thereby tracking the progress of the locomotive. Since the locomotive itinerary is based on designated railcar tasks, the location of the locomotive and progress with respect to the locomotive itinerary determines the progress of scheduled activities or tasks of the railcar. By knowing the location of the locomotives, and the location and progress of railcar tasks, the status of the railyard is known.

Additionally, system 10 described above is applicable to determine the status of airplanes at an airport, barges on a river, trucks in a truck yard, or any other scenario where a dependent object is moved and positioned by an independent object in accordance with a determined itinerary based on scheduled activities or tasks specific to the dependent object.

While the invention has been described in terms of various specific embodiments, those skilled in the art will recognize that the invention can be practiced with modification within the spirit and scope of the claims.

What is claimed is:

1. A method for monitoring a status of railcars and locomotives in a railyard using a system that tracks the location of a plurality of railcars each constituting a dependent object based on known locations of locomotives each constituting an independent object, the system including a comparator algorithm and a computer programmed with the comparator algorithm, said method comprising the steps of:

generating an independent object itinerary based on the requirements on the scheduled activities of the dependent objects;

moving the dependent objects with the independent objects in accordance with the independent object itinerary;

tracking the locations of the independent objects;

comparing the tracked independent object locations with the independent object itinerary; and determining the locations and status of the dependent objects based on the locations of the independent objects.

2. A method in accordance with claim 1 wherein the dependent object is a railcar and the independent object is a locomotive, said step of determining the location further comprises the step of determining the progress of scheduled activities for the railcar.

3. A method in accordance with claim 1 wherein said step of tracking the location further comprises the step of using a global positioning satellite system to track the independent object.

4. A method in accordance with claim 1 wherein said step of tracking the location further comprises the step of identifying the location of the independent object in reference to a network of paths.

5. A method in accordance with claim 1 wherein the system further includes at least one manager console, said step of generating the independent object itinerary further comprises the steps of:

communicating a set of dependent object information to the manager console, the manager console configured to communicate with the computer;

generating an independent object task list based on the set of dependent object information;

creating a sequence of locations the independent object will occupy;

identifying each of the locations in reference to a network of paths; and determining a start time and an end time for the independent object to occupy one of the determined locations.

6. A method in accordance with claim 5 wherein said step of computing an independent object task list further comprises the step determining at least one task to be performed by the independent object, the at least one task including positioning a dependent object at a predetermined location on a predetermined path at a predetermined time.

7. A method in accordance with claim 6 wherein said step of comparing the location further comprises the step of utilizing the comparator algorithm to compare the location of the independent object with the independent object itinerary.

8. A system for monitoring a status of railcars and locomotives in a railyard to determine the location of a plurality of railcars each constituting a dependent object based on determined locations of locomotives each constituting an independent object, the dependent objects being selectively associated with and moved by the independent objects, said system comprising:

an independent object itinerary established based on the requirements on the scheduled activities of the associated dependent object;

a list associating the dependent objects to the independent objects for predetermined segments of the independent object itinerary;

an independent object location tracking system for determining the locations of the independent objects;

a comparator algorithm for comparing the tracked independent object locations to the independent object itinerary and determining the location and status of the associated dependent objects;

a computer configured to use said comparator algorithm; and at least one manager console configured to communicate with said computer to display the status of the locomotives and railcars in the railyard.

9. A system in accordance with claim 8 wherein said dependent object comprises a railcar and the independent object comprises a locomotive.

10. A system in accordance with claim 8 wherein the independent object location tracking system configured to track a location of the independent object in reference to a known network of paths.

11. A system in accordance with claim 10 wherein the independent object location tracking system comprises a global positioning satellite system.

12. A system in accordance with claim 8 wherein said computer further configured to generate the independent object itinerary.

13. A system in accordance with claim 8 wherein said at least one manager console further comprises an input device configured to communicate a set of dependent object information to said at least one manager console.

14. A system in accordance with claim 13 wherein said computer further configured to utilize the set of dependent object information to generate an independent object task list.

15. A system in accordance with claim 14 wherein the independent object itinerary comprises a sequence of locations the independent object will occupy while executing the independent object task list.

16. A system in accordance with claim 14 wherein the independent object task list comprises a sequence of tasks to be performed by the independent object.

17. A system in accordance with claim 16 wherein the at least one task comprises positioning the dependent object at a predetermined location on a predetermined path at a predetermined time.

18. A system in accordance with claim 16 wherein said computer further configured to use said comparator algorithm to compare the location of the independent object with the task.

19. A system in accordance with claim 16 wherein said independent object itinerary further comprises a predetermined start time and a predetermined end time the independent object is projected to occupy a location while executing the independent object task list.

20. A system for monitoring the status of scheduled activities for a plurality of railcars each constituting a dependent object based on determined locations of locomotives each constituting an independent object, the dependent objects being selectively associated with and moved by the independent objects, said system comprising:

a dependent object activity schedule;

a comparator algorithm for comparing the independent object locations and the dependent activity schedule to determine the location of the dependent objects; and a computer configured to use said comparator algorithm.

21. A system in accordance with claim 20 wherein said computer further comprising a processor configured to execute said comparator algorithm, a display configured to display information, and an input device configured to input information to said computer.

22. A system in accordance with claim 20 further comprising an independent object location tracking system configured to track a location of the independent object.

23. A system in accordance with claim 20 wherein said dependent object activity schedule comprises a sequence of activities and the corresponding locations the dependent object will occupy while executing the dependent object activity schedule.

24. A system in accordance with claim 20 wherein said dependent object activity schedule further comprises a predetermined start time and predetermined end time that the dependent object is scheduled to occupy a location.

* * * * *